United States Patent [19]

Moshier

[11] Patent Number: 4,953,233

[45] Date of Patent: Sep. 4, 1990

[54] BRASSIERE STRAP RETAINER

[76] Inventor: David R. Moshier, 18620 Hatteras, #275, Tarzana, Calif. 91356

[21] Appl. No.: 357,839

[22] Filed: May 30, 1989

Related U.S. Application Data

[63] Continuation-in-part of Ser. No. 232,055, Aug. 15, 1988.

[51] Int. Cl.[5] ..... A41F 15/02

[52] U.S. Cl. ..... 2/268; 450/86

[58] Field of Search ..... 2/268; 450/86; 224/901, 224/264

[56] References Cited

U.S. PATENT DOCUMENTS

| | | | |
|---|---|---|---|
| 4,125,904 | 11/1978 | Levine | 2/267 |
| 4,382,303 | 5/1983 | Lunt | 2/114 |
| 4,575,874 | 3/1986 | Johnson | 2/268 |
| 4,612,935 | 9/1986 | Greifer | 2/268 |
| 4,704,745 | 11/1987 | Reaver | 2/268 |
| 4,764,988 | 8/1988 | Reaver | 2/268 |

*Primary Examiner*—Werner H. Schroeder
*Assistant Examiner*—Jeanette E. Chapman
*Attorney, Agent, or Firm*—John J. Posta, Jr.

[57] ABSTRACT

A brassiere strap retainer includes a first strip of Velcro material bearing hooks on one side thereof, and a second strip of Velcro material having a hook-receiving pad on one side thereof. The pad of the second strip faces the hooks and one end of the pad strip is secured to the hook-bearing strip, as by glue, sewing or the like. In one embodiment, the pad-bearing strip is shorter in length than the hook-bearing strip and is positioned thereagainst so as to expose both opposite ends of the hook-bearing side of the hook strip. The pad-bearing strip forms an openable flap, between which flap and the adjacent hook-bearing strip surface a brassiere strap can be releasably trapped. The exposed hook portions of the strip are used to releasably anchor the strap to the interior of a woman's upper garment so as to conceal the strap. In another embodiment, one end of the pad-bearing strip is secured to one end of the hook-bearing strip so that the two strips extend away from each other. The hook-bearing strip can be wrapped around a brassiere strap and then anchored to the pad strip. The exposed hooks of the hook-bearing strip can be used to anchor the retainer and strap to the interior of a woman's blouse, etc. In a third embodiment, one end of the pad-bearing strip is secured, as by heat sealing, to either an end or intermediate portion of the hook-bearing strip so that the pad-bearing strip overlies the hook-bearing strip. The pad-bearing strip can also bear hooks on the opposite side thereof.

10 Claims, 2 Drawing Sheets

BRASSIERE STRAP RETAINER

This is a continuation-in-part, of application Ser. No. 07/232,055, filed Aug. 15, 1988.

BACKGROUND OF THE INVENTION

1. Field of the Invention

The present invention generally relates to retainers and, more particularly, to brassiere strap retainers of an improved type.

2. Prior Art

Brassiere straps frequently form a source of embarrassment by becoming clearly visible when a brassiere is being worn under a sleeveless sweater, blouse, tank top or the like, or any upper brassiere-covering garment with a wide and/or deep neck opening and/or large arm holes. Women frequently adjust their garments under such circumstances in an attempt to conceal the brassiere straps. However, the straps have a habit of coming into view despite efforts to conceal them.

Accordingly, there is a need for a device capable of releasably keeping a brassiere strap out of sight behind a sleeveless sweater, blouse or the like, or behind an upper grament having a wide and/or deep neck opening. Such device should be small, light in weight and easily concealed. It should also be capable of being made in various forms to satisfy different requirements for upper garments of various types.

SUMMARY OF THE INVENTION

The improved brassiere strap retainer of the present invention satisfies all the foregoing needs. The retainer is substantially as set forth in the Abstract of the Disclosure.

The retainer comprises a pair of flexible strips of VELCRO hook and pad fastener or Velcro-like material joined together in a specific manner. VELCRO hook and pad fastener material characteristically comes in two releasably connecting forms, one of which bears a plurality of spaced hooks and the other of which bears VELCRO hook and pad fastener hook-recovering material. Thus, in the present strap retainer, one of the strips has a plurality of VELCRO hook and pad fastener hooks on one side thereof, while the other strip has a hook-receiving pad on one side thereof. The strip bearing the pad is secured to the other strip, as by glue, sewing or the like, so that the pad faces the hooks. In one embodiment, the pad-bearing strip is shorter in length than the hook-bearing strip and is secured thereto so that preferably both opposite ends of the hook-bearing strip are exposed. The pad-bearing strip in all embodiments forms an openable flap to releasably trap a brassiere strap between the flap and hook-bearing surface. The exposed hooks are used to releasably anchor the retainer to the brassiere strap and to the inner surface of a sweater, blouse, etc., so as to keep the brassiere strap concealed.

In a second embodiment, one end of the pad-bearing strip is secured to one end of the hook-bearing strip, with the pad and hooks facing each other, but with the strips extending away from each other. The retainer is used by looping the exposed hook-bearing strip portion around a brassiere strap, with the hooks facing away from the brassiere strap, and then releasably securing the hook-bearing strip end to the pad. Since the hooks are fully exposed in a circle around the strap, they can easily be used to anchor the retainer behind a tank top strap or the like in order to keep the brassiere strap concealed. Such a retainer can be made small and forms a very compact unit in use in order to conceal the retainer as well as the brassiere strap.

In a third embodiment, one end of the pad-bearing strip is secured, as by heat sealing, directly to either one end or an intermediate portion of the hook-bearing strip, with the pad facing and overlying the hooks. In a further embodiment, the opposite side of the strip which bears the pad may bear additional Velcro hooks to serve as additional securing means.

Various other features and details of the improved brassiere strap retainer of the present invention are set forth in the following detailed description and accompanying drawings.

DRAWINGS

FIG. 1 is a schematic fragmentary perspective view, partly in section, of a first preferred embodiment of the improved brassiere strap retainer of the present invention, shown with the retainer releasably holding a brassiere strap and ready to be releasably secured to the inner surface of a sleeveless or wide necked sweater or the like;

DETAILED DESCRIPTION

FIGS. 1 & 2.

Figure 1:
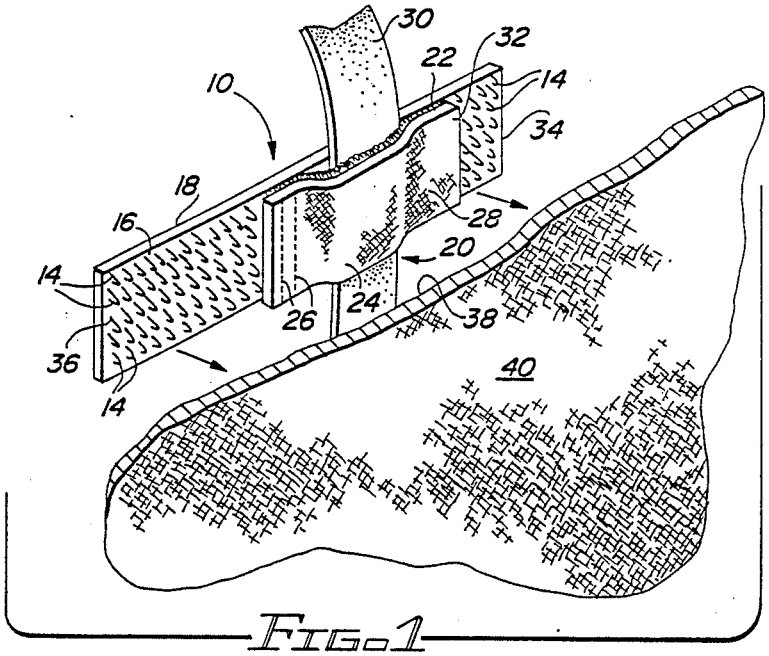
Figure 2:
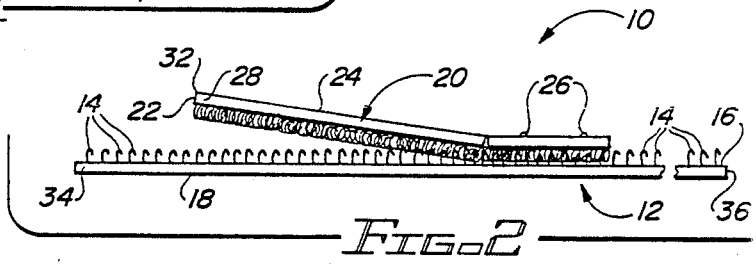
FIG. 2 is an enlarged schematic side elevation of the retainer of FIG. 1 without the brassiere strap present.

Now referring more particularly to FIGS. 1 & 2 of the accompanying drawings, a first preferred embodiment of the improved brassiere strap retainer of the present invention is schematically shown therein. Thus, retainer 10 is shown, which comprises an elongated first flexible strip 12 bearing a plurality of small spaced hooks 14 protruding from one side 16 thereof. The opposite side 18 of strip 12 bears no such hooks 14 and may be smooth.

Retainer 10 also includes a second elongated flexible strip 20 of a length less than that of hook-bearing strip 12. Strip 20 bears a hook-engaging and retaining side or pad 22 facing side 16 of strip 12, and an opposite side 24 which may be smooth and non-hook engaging, if desired. Strip 20 is fixedly secured to strip 12 adjacent one end of strip 20, as by sewing stitches 26. Alternatively, the same area of strip 20 could be glued, stapled or otherwise firmly secured to strip 12.

This arrangement provides retainer with an openable and closeable flap portion 28 of strip 20. As can be seen in FIG. 1, a brassiere strap 30 can be releasably trapped and fixedly held under flap 28; that is, between flap 28 and the adjacent portion of hook-bearing side 16. The free end 32 of flap 28 is releasably held against side 16 by engagement with hooks 14, as shown in FIG. 1.

One or both opposite ends 34 & 36 of strip 12 are left exposed so that hooks 14 on side 16 at those ends can be used to releasably secure retainer 10 in any desired location to the inner surface 38 of a brassiere-covering ladies' upper grament 40, such as a sweather, blouse, T-shirt, etc. (FIG. 1), so as to keep brassiere strap 30 fully concealed under garment 40. Retainer 10 is particularly valuable for use with garments 40 which are sleeveless and may have large arm holes, and those garmets 40 which have wide and/or deep scoop-type necks. In both instances, in the absence of retainer 10, brassiere strap 30 could be easily seen. With retainer 10 used as indicated above, however, strap 30 can be releasably anchored to surface 38 of garment 40 in a position which assures its concealment, regardless of movement of the wearer and garment 40 in use.

Retainer 10 can easily and quickly be stripped from surface 38 without any damage to it and can be subsequently relocated, as desired, on garment 40 or another garment. Flap 28 can be easily opened to free brassiere strap 30 and can be subsequently closed again to releasably trap another strap 30. Thus, retainer 10 is fully reusable, is durable, efficient and inexpensive. It can be made very small, if desired, and in a range of shapes and sizes. Retainer 10 is preferably formed of conventional VELCRO hook and pad fastener cloth material, with both of strips 12 and 20 comprising such material. Any equivalent velcro-type material can also be used. Such material can be obtained in a variety of colors, as desired, for cosmetic and concealment purposes.

FIGS. 3 & 4

Figure 3:
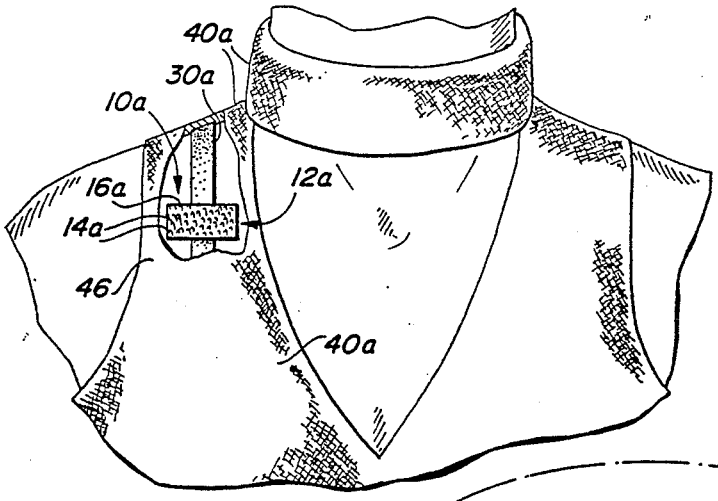
FIG. 3 is a schematic front elevation, partly broken away, of a second preferred embodiment of the improved brassiere strap retainer of the present invention, shown attached to the inside of the shoulder (strap) area of a tank top blouse and encircling and anchoring a brassiere strap.
Figure 4:
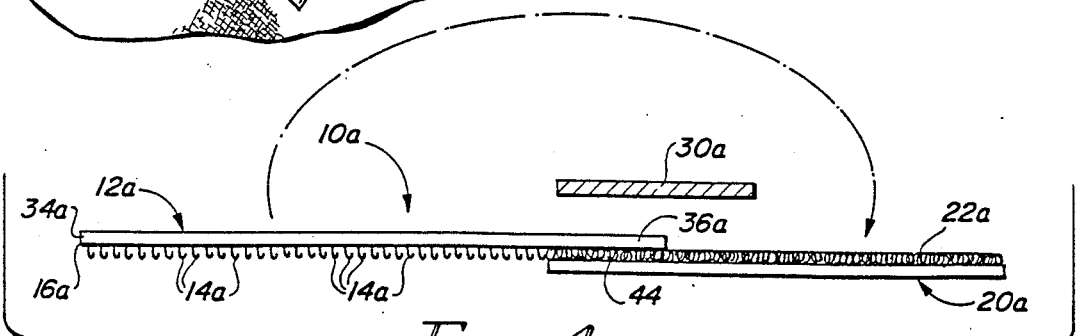
FIG. 4 is an enlarged schematic side elevation, partly in section, of the retainer of FIG. 3, shown before encircling a brassiere strap.

A second preferred embodiment of the improved brassiere strap retainer of the present invention is schematically depicted in FIGS. 3 & 4. Thus, retainer **10*a* is shown. Components of retainer 10*a* which are similar to those of retainer 10 bear the same numerals but are succeeded by the letter "a". Retainer 10*a* is substantially identical to retainer 10**, except as follows:

Strip **12*a* is fixedly secured at end 36*a* thereof to one end of strip 20*a* by a line of glue 44, with hooks 14*a* facing hook-receiving side 22*a*. Retainer 10*a* is used by bending strip 12*a* in a circle closely around strap 30*a* in the direction of the arrow in FIG. 4 to trap strip 30*a* with side 16 of strip 12*a* being exposed, as shown in FIG. 3 and facing away from strip 30*a*. End 34*a* of strip 12*a* is then releasably connected to the exposed portion of pad side 22*a* of strip 20*a* to releasably hold garment 40*a* in place over strap 30*a*** in place.

In FIG. 3, retainer **10*a* is shown on strap 30*a* under a sleeveless, turtle-necked, deep V tank top garment 40*a*. Hooks 14*a* releasably secure strap 30*a*, without damage to strap 30*a*, to the inner surface of garment 40*a* at any desired location, for example, in the shoulder-crest region, under the broad strap 46 of garment 40*a*. Garment 46 can be reanchored in any location, as desired, and can be released easily from retainer 10*a*. Preferably, retainer 10*a* is small and of neutral color for easy concealment under even very narrow straps 46. Retainer 10*a* has the other advantages of retainer 10**.

FIG. 5.

Figure 5:
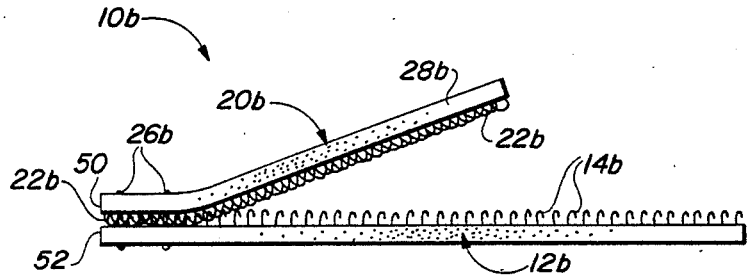
FIG. 5 is an enlarged schematic side elevation, of a third preferred embodiment of the improved brassiere strap retainer of the present invention.

A third preferred embodiment of the improved brassiere strap retainer of the present invention is schematically depicted in FIG. 5. Thus, retainer **10*b* is shown. Components thereof similar to those of retainer 10 or retainer 10*a*** bear the same numerals but are succeeded by the letter "b".

Retainer **10*b* differs from retainer 10** only as follows:

One end 50 of strip **20*b* is fixedly secured directly to one end 52 of strip 12*b*, as by stitching 26*b* or the like, so that strip 20*b* extends over strip 12*b*, with flap 28*b* also over strip 12*b*, in contrast to retainer 10*a* wherein strips 12*a* and 20*a*** extend longitudinally away from each other.

Retainer **10*b* has substantially the advantages of retainer 10**.

FIGS. 6 & 7

Figure 6:
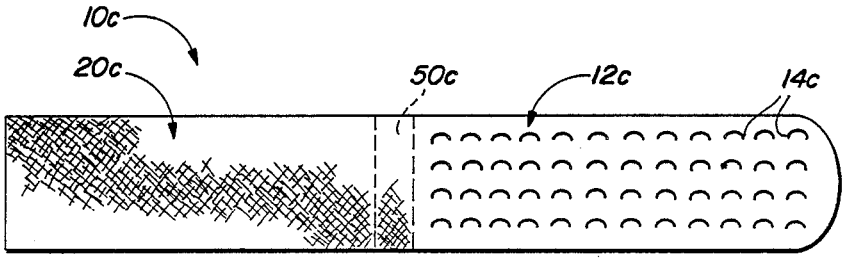
FIG. 6 is a schematic enlarged top plan view of a fourth preferred embodiment of the improved brassiere strap retainer of the present invention.
Figure 7:
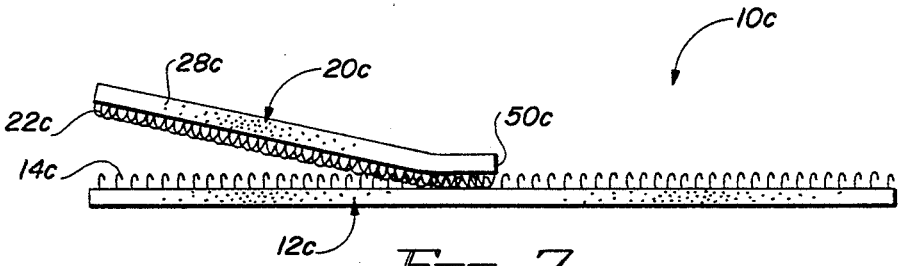
FIG. 7 is a schematic side elevation of the retainer of FIG. 6.

A fourth preferred embodiment of the improved retainer of the present invention is schematically depicted in FIGS. 6 & 7. Thus, retainer **10*c* is shown. Components thereof similar to those of any of retainers 10, 10*a* and 10*b*** bear the same numerals but are succeeded by the letter "c".

Retainer **10*c* differs from retainer 10*b*** only as follows:

end **50*c* of strip 20*c* is fixedly secured, as by heat sealing, directly to strip 12*c* intermediate opposite ends of strip 12*c*, so that flap 28*c* and the remainer of strip 20*c* overlie strip 12*c*. Obviously, strip 20*c* and strip 12*c*** are heat sealable materials.

Retainer **10*c* has the advantages of retainers 10, 10*a* and 10*b***.

FIG. 8

Figure 8:
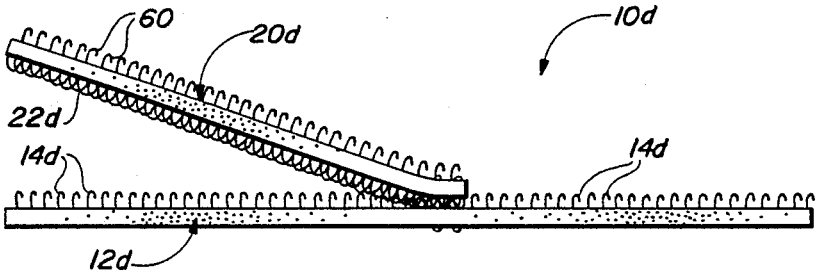
FIG. 8 is a schematic enlarged side elevation of a fifth preferred embodiment of the improved brassiere strap retainer of the present invention.

A fifth preferred embodiment of the improved retainer of the present invention is schematically depicted in FIG. 8. Thus, retainer **10*d* is shown. Components thereof similar to those of any of retainers 10, 10*a*, 10*b* and 10*c*** bear the same numerals but are succeeded by the letter "d".

Retainer **10*d* differs from retainer 10*c*** only as follows:

strip **20*d* bears VELCRO hook and pad fastener hooks 60 on the side thereof opposite that which bears pad 22*d*, so that retainer 10*d*** has additional means of releasably securing itself to an outer garment.

Retainer **10*d* has the advantages of retainer 10*c***.

Various modifications, changes, alterations and additions can be made in the improved brassiere strap retainer of the present invention, its components and parameters. All such modifications, changes, alterations and additions as are within the scope of the appended claims form part of the present invention.

What is claimed is:

1. An improved brassiere strap retainer, said retainer comprising, in combination:

(a) a first flexible strip of hook and pad fastener material bearing hooks on one side thereof;

(b) a second flexible strip having a pad of hook-receiving hook and pad fastener material on one side thereof, facing said first flexible strip, one end of said second flexible strip being fixedly secured to said first flexible strip to expose a portion of said first flexible strip, said second flexible strip including a strap-receiving portion releasably secureable to said first flexible strip so as to releasably trap a brassiere strap between said strips, said exposed portion of said first flexible strip being adapted to releasably hook to a inner surface of a female garment covering said brassiere, so as to control the location of the garment in order to conceal the brassiere strap, and (c) wherein said second flexible strip is fixedly secured to said first flexible strip so as to expose both opposite ends of said first flexible strip.

2. The improved brassiere strap retainer of claim 1 wherein said second flexible strip is shorter in length than said first flexible strip.

3. The improved brassiere strap retainer of claim 2 wherein said second flexible strip is fixedly heat sealed directly to said first flexible strip.

4. An improved brassiere strap retainer, said retainer comprising, in combination:

(a) a first flexible strip of hook and pad fastener material bearing hooks on one side thereof;

(b) a second flexible strip having a pad of hook-receiving hook and pad fastener material on one side thereof, facing said first flexible strip, one end of said second flexible strip being fixedly secured to said first flexible strip to expose a portion of said first flexible strip, said second flexible strip including a strap-receiving portion releasably secureable to said first flexible strip so as to releasably trap a brassiere strap between said strips, said exposed portion of said first flexible strip being adapted to releasably hook to the inner surface of a female garment covering said brassiere, so as to control the location of the garment in order to conceal the brassiere strap, and (c) wherein said strap-receiving portion is on said second flexible strip and is releasably secured to said first flexible strip.

5. The improved brassiere strap retainer of claim 4 wherein one end of said second flexible strip is connected to one end of said first flexible strip, whereby an exposed hook portion of said first flexible strip can be looped over and around a brassiere strap and be releasably connected to an exposed portion of said second flexible strip, with the hooks of said first flexible strip facing away from said brassiere strap and adapted to be releasably secured to said inner surface of said female brassiere covering garment.

6. The improved brassiere strap retainer of claim 5 wherein said second flexible strip extends longitudinally away from said first flexible strip, only said connected end of said strips overlying each other.

7. An improved brassiere strap retainer, comprising:

(a) an elongated member having a first fastening means to aid in releasably securing said member to a brassiere strap; and, (b) said elongated member having a second fastening means to cooperate with said first fastening means for releasably securing said member to a underside of a garment, (c) wherein said garment is maintained in a relatively fixed position with respect to said brassiere strap, (d) said first fastening means includes a first flexible strip of hook and pad fastener material bearing hooks on one side thereof; and, (e) wherein said second fastening means includes a second flexible strip having a pad of hook-receiving hook and pad fastener material on one side thereof, facing said first flexible strip, one end of said second flexible strip being fixedly secured to said first flexible strip to expose a portion of said first flexible strip and to provide an openable brassiere strap-receiving portion releasably secureable to said first flexible strip so as to releasably trap a brassiere strap between said strips, said exposed portion of said strip being adapted to releasably hook to an inner surface of a female garment covering said brassiere, so as to control the location of said garment in order to conceal the brassiere strap, and (f) wherein said second flexible strip is fixedly secured to said first flexible strip so as to expose both opposite ends of said first flexible strip.

8. The improved brassiere strap retainer of claim 11 wherein said second flexible strip is shorter in length than said first flexible strip.

9. An improved brassiere strap retainer, comprising:

(a) an elongated member having a first fastening means to aid in releasably securing said member to a brassiere strap; and, (b) said elongated member having a second fastening means to cooperate with said first fastening means for releasably securing said member to a underside of a garment, (c) wherein said garment is maintained in a relatively fixed position with respect to said brassiere strap, (d) said first fastening means includes a first flexible strip of VELCRO hook and pad fastener material bearing hooks on one side thereof; and, (e) wherein said second fastening means includes a second flexible strip having a pad of hook-receiving VELCRO hook and pad fastener material on one side thereof, facing said first flexible strip, one end of said second flexible strip being fixedly secured to said first flexible strip to expose a portion of said first flexible strip and to provide an openable brassiere strap-receiving portion releasably secureable to said first flexible strip so as to releasably trap a brassiere strap between said strips, said exposed portion of said first flexible strip being adapted to releasably hook to an inner surface of a female garment covering said brasseire, so as to control the location of said garment in order to conceal the brassiere strap, and (f) wherein said strap-receiving portion is on said second flexible strip and is releasably secured to said first flexible strip.

10. The improved brassiere strap retainer of claim 9 wherein one end of said second flexible strip is connected to one end of said first flexible strip, whereby an exposed hook portion of said first flexible strip can be looped over and around a brassiere strap and be releasably connected to an exposed portion of said second flexible strip, with the hooks of said first flexible strip facing away from said brassiere strap and adapted to be releasably secured to said inner surface of said female brassiere covering garment.

* * * * *